US009073058B2

(12) United States Patent
Voelker et al.

(10) Patent No.: US 9,073,058 B2
(45) Date of Patent: Jul. 7, 2015

(54) WOOD CHIPPING APPARATUS AND METHOD

(71) Applicant: Morbark, Inc., Winn, MI (US)

(72) Inventors: Larry E. Voelker, Cadillac, MI (US); Nathaniel M. Bott, Shepherd, MI (US); Daniel R. Pung, Mount Pleasant, MI (US); Michael T. Hadanek, Wheeler, MI (US)

(73) Assignee: Morbark, Inc., Winn, MI (US)

( * ) Notice: Subject to any disclaimer, the term of this patent is extended or adjusted under 35 U.S.C. 154(b) by 177 days.

(21) Appl. No.: 13/783,490

(22) Filed: Mar. 4, 2013

(65) Prior Publication Data

US 2014/0246526 A1 Sep. 4, 2014

(51) Int. Cl.
*B02C 23/24* (2006.01)
*B02C 18/22* (2006.01)

(52) U.S. Cl.
CPC ..... *B02C 23/24* (2013.01); *B02C 18/2216* (2013.01)

(58) Field of Classification Search
CPC .... B27L 11/002; B02C 18/2216; B02C 23/24
USPC ..... 241/28, 56, 18, 19, 92
See application file for complete search history.

(56) References Cited

U.S. PATENT DOCUMENTS

| | | | | |
|---|---|---|---|---|
| 3,123,311 | A | 3/1964 | Fontaine | |
| 3,276,700 | A | 10/1966 | Eklund | |
| 3,332,461 | A | 7/1967 | Ledergerber | |
| 3,410,495 | A | 11/1968 | Eklund | |
| 3,635,410 | A | 1/1972 | Smith | |
| 3,682,400 | A | 8/1972 | Smith | |
| 5,060,873 | A | 10/1991 | Strong | |
| 5,240,188 | A | 8/1993 | Whitmire | |
| 5,240,189 | A | 8/1993 | Majkrzak et al. | |
| 6,179,232 | B1 | 1/2001 | Schumacher | |
| 6,550,702 | B2 * | 4/2003 | Champlin | 241/55 |

* cited by examiner

*Primary Examiner* — Mark Rosenbaum
(74) *Attorney, Agent, or Firm* — Warner Norcorss & Judd LLP

(57) ABSTRACT

A wood chipper with an air entrainment system. The wood chipper includes a chipping drum in a drum chamber and a discharge fan in a fan chamber. The chipping drum and fan are conjointly driven by a common shaft. The discharge fan draws air from the drum chamber through a chamber air inlet and potentially also from the ambient atmosphere through an external air inlet. The volume of air drawn from the drum chamber is sufficient to offset or overcome the negative air flow created by the spinning drum in the drum chamber to reduce blowback. Air entrained with the chipped material moves toward the discharge chute and away from the material inlet. A deflector may be include near the mouth of the discharge chute to further guide air flow from the fan chamber toward the discharge chute and prevent the backflow of air into the chipping chamber.

22 Claims, 8 Drawing Sheets

WOOD CHIPPING APPARATUS AND METHOD

BACKGROUND OF THE INVENTION

The present invention relates to a drum-type wood chipper and more particularly to an apparatus and method for handling air within a drum-type wood chipper.

Drum-type wood chippers of the kind typically used to chip tree stems, tree limbs, branches, brush, wood scraps and other wood debris often include a housing having an internal chamber in which a chipper drum is supported for driven rotation. The drum carries a plurality of cutting knives spaced about its perimeter which, when wood debris is fed into the chamber, reduce the limbs and such to chips. The chips are discharged through an outlet in the chamber and transported by their momentum along a discharge chute for collection, typically in a chamber or bin, such as that provided on a towing vehicle used to transport the chipper.

As the type of wood and size of the chips can vary, it is not uncommon for some of the chips to be too light such that they have insufficient momentum to travel the length of the discharge chute and collect in the chamber. One proposed solution to the problem has been to add fan blades to the side of the drum in order to generate a flow of air in the chipping chamber to help carry the chips along. The flow of air, however, is difficult to control and in some cases an undesirable backflow develops wherein dust and light debris is discharged through the material inlet.

Another proposal has been to equip such chippers with a discharge fan external to the housing that is driven off the drum shaft and is coupled by a hose to the discharge chute for creating an air flow in the chute downstream of the outlet which acts to draw and carry the chips along and into the collection bin. While such external fan devices are effective at entraining the chips, there is not always room enough on the chipper apparatus to accommodate the mounting of the external fan assembly. Further, the necessity of an additional air hose from the fan to the discharge chamber detracts from the appearance of the chipper apparatus, is prone to damage, and adds to the maintenance and cost of the apparatus.

One particularly effective drum-type wood chipper is fitted with a discharge fan internal to the housing of the chipping chamber, but isolated from this chamber by a circumferentially extending chamber wall. Air is drawn into the fan chamber through an inlet communicating with the air outside the chipping apparatus and discharged at a high velocity through an outlet of the fan chamber. A baffle separates the outlet of the fan chamber from a discharge area for the material being chipped in the drum. Air entering an exit chute from the fan chamber joins a flow of chips from the chipper and entrains the chips to carry them out of the material exit chute. The baffle prevents the stream of air from the fan chamber from flowing back into the chipping chamber. Although a marked improvement, this design does not overcome the problems of "blowback" from the drum chamber. Blowback occurs when the spinning of the chipper drum in the chipping chamber forces air out in all directions thus blowing air, chips and dust out the material infeed toward the operator.

SUMMARY OF THE INVENTION

The present invention provides a drum-type wood chipper having a discharge fan with an inlet that draws air into the fan from within the drum chamber and an outlet that exhausts air to assist in propelling wood chips from the chipper. The chipping drum and the discharge fan may be disposed within a common housing. Further, the discharge fan may be carried on the chipping drum shaft so that it rotates with the drum.

In one embodiment, the wood chipper has a housing with an internal chipping chamber defined by one or more peripheral walls. The housing may include a material inlet in a peripheral wall to permit wood debris to be fed into the chipping chamber. The housing may also include an outlet in a peripheral wall to allow chipped material to exit the chipping chamber. The wood chipper may have a discharge chute coupled to the outlet to direct the flow of chipped material from the wood chipper.

In one embodiment, the wood chipper includes a base at the bottom of the chipping chamber that separates the chipping chamber into a drum chamber and a fan chamber. The chipping drum may be rotatably mounted inside the drum chamber on a shaft. The discharge fan may be rotatably mounted inside the fan chamber, also supported by the shaft. The fan chamber may be separated from the drum chamber by a partition wall. The fan chamber may receive air from the drum chamber through a drum chamber air inlet in the partition wall, and also from an external air inlet opposite said drum chamber air inlet. In operation, the discharge fan may create air flow in the direction from the drum chamber inlet and the external inlet toward the outlet and the discharge chute.

In one embodiment, the fan in the chipping apparatus includes a disc with blades affixed to the side of the disc facing the drum chamber inlet. Additionally or alternatively, the fan also has blades affixed to the side of the disc facing the external air inlet.

Another embodiment includes a deflector attached to the peripheral wall of apparatus. The deflector may be installed in the transition area between the discharge outlet and the peripheral wall. In use, the deflector may help to increase the amount of air flow out to the discharge.

Further embodiments include an air entrainment system for a wood reduction apparatus. In this embodiment, the system includes a fan chamber internal to the housing and separated from the drum chamber by a partition wall. A cutout in the partition wall allows for fluid communication between the drum chamber and the fan chamber. An external air inlet allows ambient air into the fan chamber from outside the housing. The fan draws air from the drum chamber and from outside the housing and the air moves toward the discharge end of the apparatus.

The wood chipper may further provide a common shaft to support both the fan and the chipping drum. The shaft allows conjoint rotation of the fan and the drum.

In another aspect, the present invention provides a method for reducing wood debris in a wood chipper. The method generally includes the steps of providing a wood chipper having a material inlet, a drum chamber, a fan chamber and a discharge chute; rotatably disposing a chipping drum in the drum chamber; rotatably disposing a discharge fan in the fan chamber; providing an air passage from the drum chamber to the fan chamber; and rotating the chipper drum and the fan so that air is drawn into the fan chamber from the drum chamber and expelled through the discharge chute. The method may further include the steps of providing an air passage between the fan chamber and the exterior, and operating the fan so that air drawn into the fan chamber from the drum chamber and the exterior.

The present invention provides a simple and effective system that can effectively manage blowback while providing air flow to assist in discharging chipped materials from the wood chipper. The system is relatively inexpensive to implement and operate as it can be contained within the drum chipper housing and be driven by the power source for the drum chipper. The desired air flow can be easily tuned by controlling various aspects of the system. For example, the size, shape and configuration of the fan, fan blades, drum chamber air inlet, external air inlet baffle. In those embodiments that incorporate a deflector in the transition area, the deflector may help to increase the amount of air flow out the discharge.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENT

Figure 1:
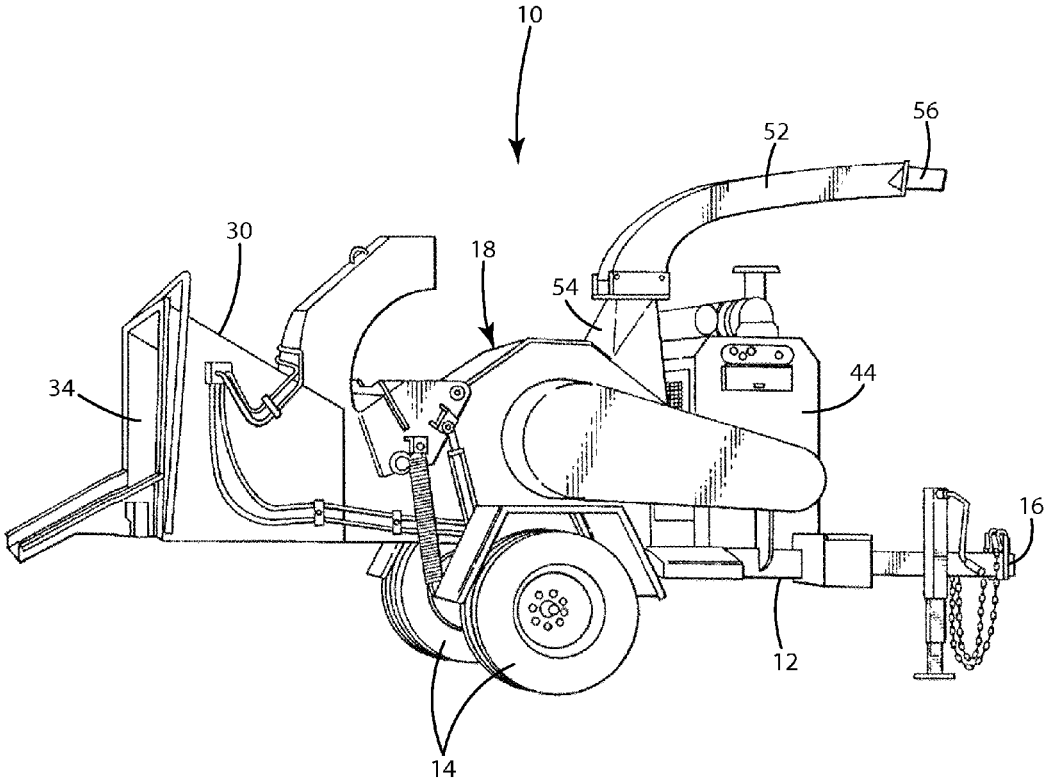
FIG. 1 is a side elevation view of the chipping apparatus.

An apparatus for reducing tree stems, tree limbs, branches, brush, wood scraps and other wood debris to wood chips in accordance with one embodiment of the present invention is shown generally as 10 in FIG. 1. In the illustrated embodiment, the apparatus 10 (or wood chipper 10) generally includes a housing 18 with an internal chipping chamber 20, a chipping drum 22 rotatably supported in the chipping chamber 20, a material infeed chute 30 extending rearwardly from the housing 18, a powered feed system 17 disposed into the material infeed chute 30 to feed material from the infeed chute 30 into the chipping drum 22, a discharge chute 52 extending forwardly from the housing 18 for exhausting material from the chipper 10 and an air entrainment system 58 to assist in moving wood chips and other debris out of the wood chipper through the discharge chute 52. A base 21 of the chipping chamber 20 is divided into a drum chamber 23 and a fan chamber 60 separated by a partition wall 26. The air entrainment system 58 includes a discharge fan 70 that draws air from the drum chamber 23 (and optionally from the exterior) and expels it through the discharge chute 52. By drawing air in from the drum chamber 23, the discharge fan 70 helps to reduce "blowback" (e.g. air, dust and debris forced from the chipping chamber 20 back toward the operator by the spinning drum 22). The discharge fan 70 and related components may be configured so that the discharge fan 70 draws a sufficient volume of air in the infeed to offset or overcome the negative air flow created by the spinning drum 22. In operation, this limits the amount of air, dust and chips that are ejected toward the operator feeding material into the wood chipper 10.

For purposes of disclosure, the present invention is described in connection with a drum-type wood chipper that is intended to be towed by a vehicle. In this embodiment, the wood chipper 10 has a support frame 12 mounted to a set of wheels 14 and has a coupling 16 at its forward end for coupling the wood chipper 10 to a towing vehicle (not shown). While any of a number of towing vehicles may be suitable, the towing vehicle may be of a type having a collection bin that is open at the back to receive the wood chips discharged from the wood chipper 10, as will be explained further below. Although described in connection with a drum-type chipper, the present invention may be implemented in other types of wood reduction machines that might benefit a discharge fan configured to draw air through the infeed to address "blowback" or other similar problems.

The wood chipper 10 of the embodiment illustrated in FIGS. 1-8 is in some regards conventional in construction and operation. For example, the wood chipper 10 is similar in some regards to the MORBARK® BEEVER™ Chippers manufactured by Morbark, Inc. in Winn, Mich.

Figure 2:
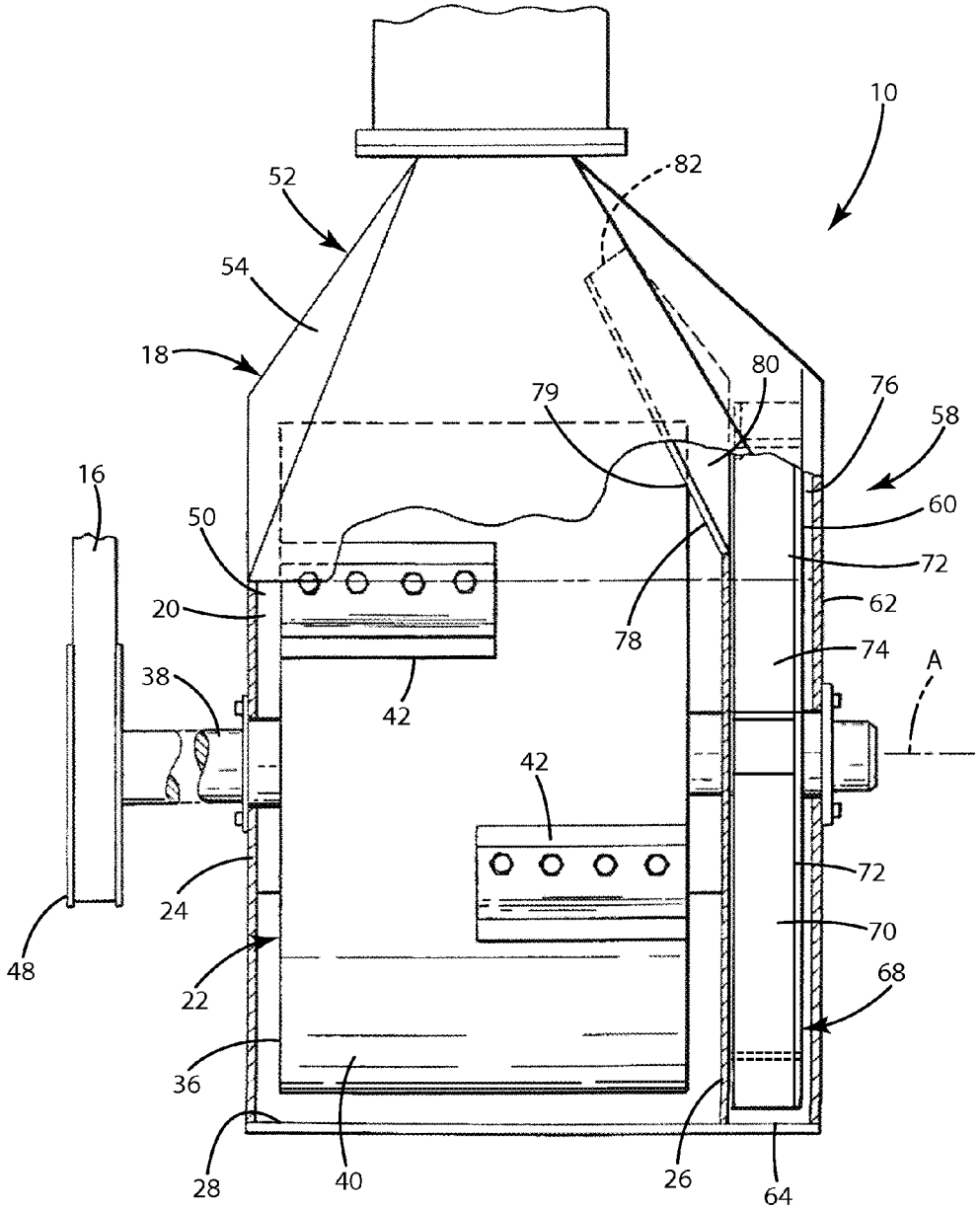
FIG. 2 is a cross-sectional view of the drum and fan chambers.

As noted above, in this embodiment, the housing 18 is mounted to the frame 12 and includes an internal chipping chamber 20 in which a chipping drum 22 is supported for driven rotation about an axis A, as shown best in FIG. 2. The chipping chamber 20 includes a base 21 and axially spaced end walls 24 and 26 and a peripheral circumferentially extending wall 28 joined, for example by welding, to provide the internal chipping chamber 20.

Figure 7:
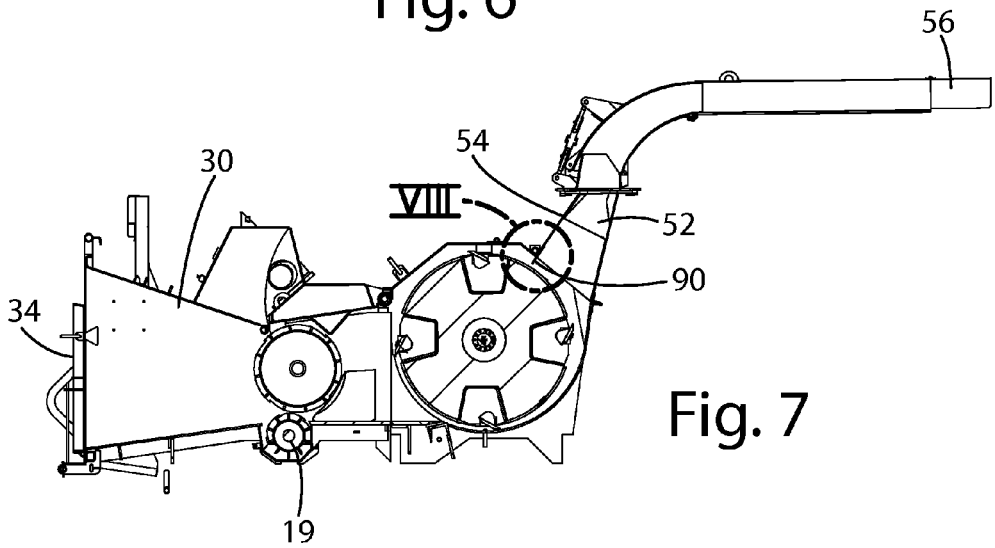
FIG. 7 is a cross-sectional view of a portion of the apparatus taken along line A-A of FIG. 6.

As best shown in FIG. 1, a material feed chute 30 extends longitudinally rearwardly from the housing 18 to an open end that serves as a material inlet 34 into which wood debris to be chipped is fed by an attendant. Within the chute 30 is a rotatably driven feed system 17 (as seen in FIG. 7) which includes upper and lower feed wheels 19*a* and 19*b* that engage and feeds the wood debris at a predetermined rate into the chipping chamber 20 through the material inlet 34 provided in the peripheral chamber wall 28. As the wood debris enters the chipping chamber 20, it encounters the spinning chipping drum 22. The drum 22 may be of essentially any type. In the illustrated embodiment, the drum 22 has a circumferentially extending wall 40 generally parallel to and spaced radially from the peripheral wall 28 of the housing 18.

In this embodiment, a plurality of replaceable chipping knives 42 are mounted about the wall 40 for rotation therewith about the axis A. In the illustrated embodiment, the shaft 38 extends through and is journaled by the end walls of the housing 18 and is coupled to a drive motor 44 mounted on the frame 12 by a suitable drive connection, such as a belt and pulleys 46 and 48.

The drum 22 of this embodiment is rotated at a high velocity in a downwardly, counterclockwise direction as viewed in FIG. 7, such that the debris fed into the chamber 20 passes beneath the drum 22. The drum 22 may be rotated in the opposite direction, if desired. As the wood debris encounters the drum 22, the knives 42 reduce the material to wood chips. The high velocity of the drum 22 carries the chips through the chamber 20 and ejects them through a material outlet 50 provided in the chamber wall 28 on the opposite side of the housing 18 as that of the material inlet 34.

The apparatus 10 includes a discharge chute 52 coupled at a receiving end 54 thereof to the housing 18 in communication with the material outlet 50 for receiving and guiding the wood chips expelled from the chipping chamber 20 outwardly of the housing 18 to an opposite discharge end 56 of the chute 52, where they may be expelled into an adjacent collection bin, such as that on the towing vehicle.

Figure 3A:
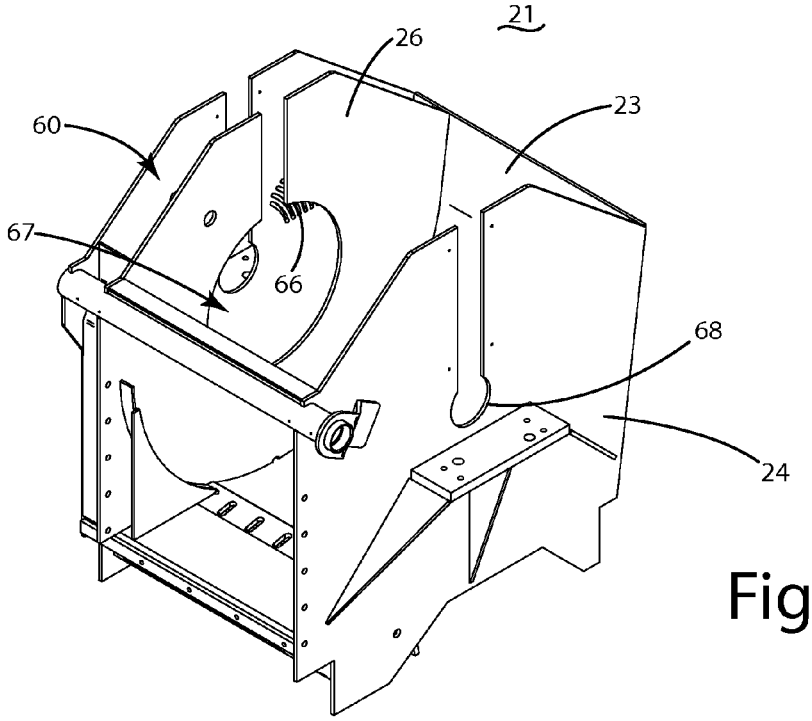
FIG. 3A is perspective view of the base of the chipping chamber.
Figure 3B:
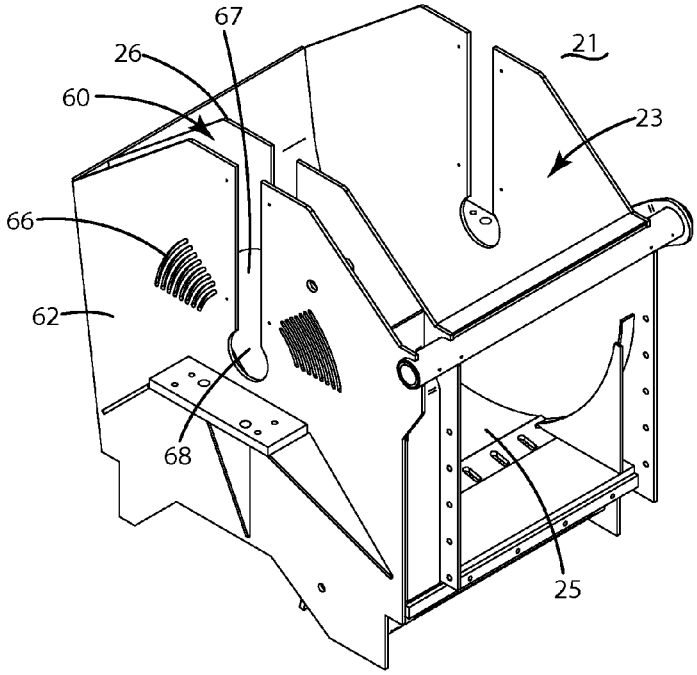
FIG. 3B is a perspective view of the base of the chipping chamber.

To provide airflow through the chipping chamber 20 toward the discharge chute 52, an entrainment system 58 in provided. The entrainment system 58 of this embodiment includes a base 21 (as best shown in FIGS. 3A and 3B) that is fitted into the bottom of the chipping chamber 20. The base 21 generally includes a bottom 25, a pair of end walls 24 and 62 and a partition wall 26. The base 21 generally divides the chipping chamber 20 into a drum chamber 23 and a fan chamber 60. The fan chamber 60 is generally defined by outer wall 62 and partition wall 26. The outer wall 62 defining a plurality of ambient air inlets 66 allowing fluid communication between the fan chamber 60 and the external, ambient atmosphere to draw air into the fan chamber 60. The drum chamber 23 is generally defined by outer wall 24 and partition wall 26. The partition wall 26 includes a cutout or opening that forms an air inlet 67 through which air flows from the drum chamber 23 into the fan chamber 60. A baffle 78 extends the partition wall 26 toward the discharge chute 52. The baffle 78 has a chip side 79 communicating with the chipping chamber 20 and an air side 80 communicating with the fan chamber 60. By drawing air from the drum chamber 23 in addition to drawing air through the external or ambient air inlets 66 blowback of air flow from the chipping chamber 20 toward the material inlet 34 is reduced. Having dual air inlets 66 and 67 to the fan chamber 60 allows the fan to pull a sufficient volume of air from the chipping chamber 20 to overcome the negative air flow crated by the spinning chipping drum 22. This arrangement, therefore, limits the amount of chips and dust that are ejected toward the operator. Shaft openings 68 in the base 21 accommodate the shaft 38 and allow the chipping drum 22 to be fitted into the base 21.

Figure 4A:
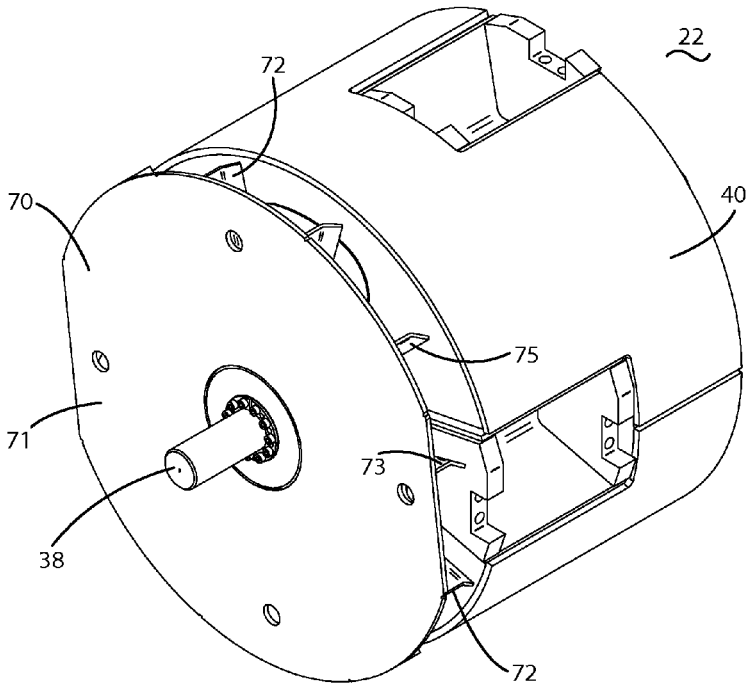
FIG. 4A is a perspective view of the drum and fan.
Figure 4B:
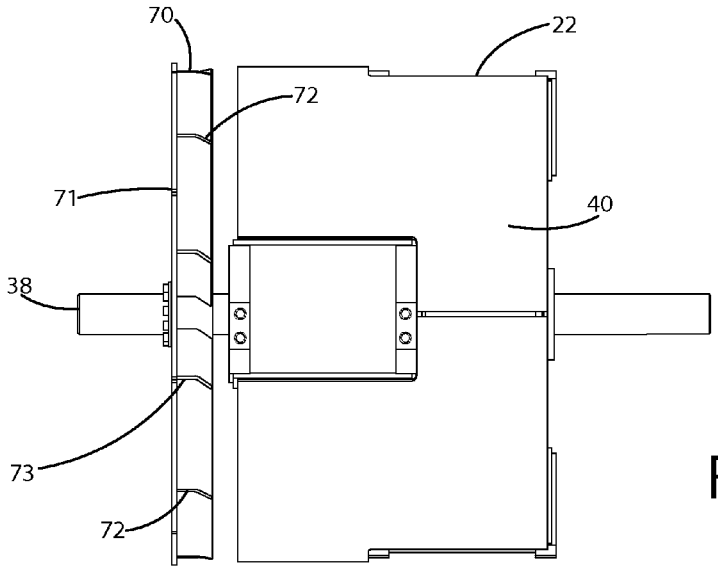
FIG. 4B is a top view of the drum and fan of FIG. 4A.

Referring to FIGS. 4A and 4B, the fan 70 of the entrainment system 58 includes a disc-like body 71 and a plurality of blades 72 on the side of the disc-like body facing the partition wall 26 with the air inlet 67. The placement of blades 72 on the side of the disc-like body 71 facing the air inlet 67 facilitates movement of air from the drum chamber 23 into the fan chamber 60 through the air inlet 67. The fan 70 is aligned axially with the drum 22. Both the fan 70 and the drum 22 are fixed to the shaft 38 for conjoint rotation. As shown, the fan blades 72 have a base 73 that is joined to the fan 70 in a substantially perpendicular orientation. The blade tips 75 are bent out of the perpendicular orientation with the fan 70. The blades 72, however, can be shaped in a variety of ways to impact the aerodynamics of the fan 70, as desired. The number of blades 72, distance separating the blades 72 and their shape, thickness and pitch can increase or decrease the amount of air flow created by the fan 70.

Figure 5A:
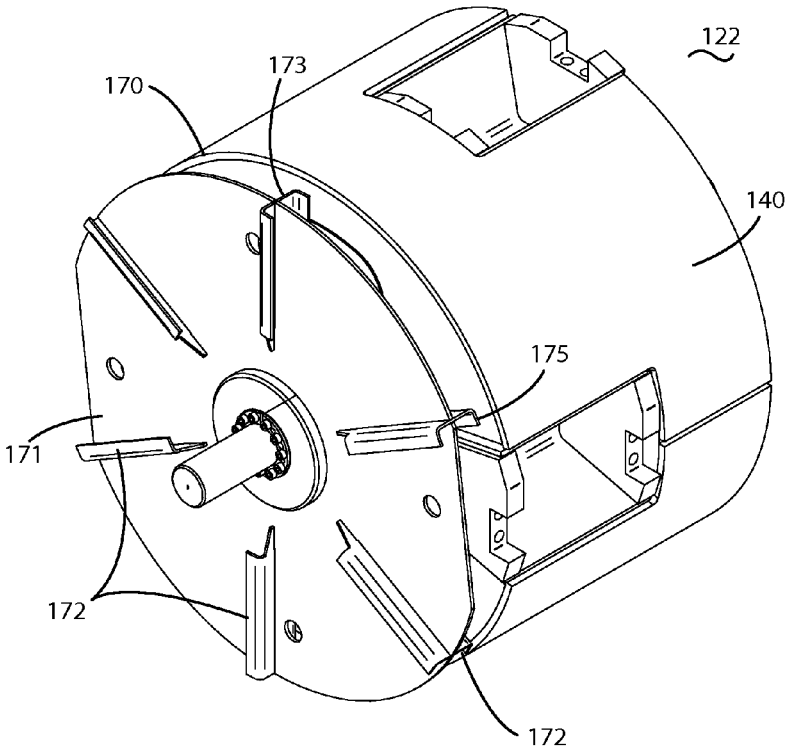
FIG. 5A is a perspective view of the drum and fan with two sets of blades.
Figure 5B:
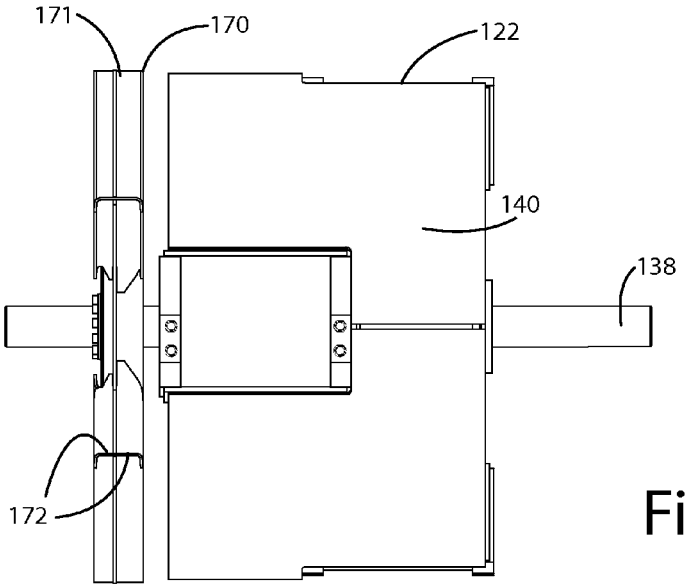
FIG. 5B is a top view of the drum and fan of FIG. 5A.

As shown in FIGS. 5A and 5B, the fan 170 may include blades 172 on both sides of the disc-like body 171. This arrangement serves to increase and can optimize the amount of air flow created by the fan 70 toward the discharge 52. By increasing the air flow toward the discharge chute 52, this embodiment further facilitates air flow from the chipping chamber 20 through the drum chamber 23 and into the fan chamber 60 through the inlet 67 and reduces blowback of air toward the inlet 34. In this embodiment, the blade base 173 is joined to the fan 170 in a substantially perpendicular orientation and the blade tips 175 are oriented substantially parallel to the fan 170 disc-like body 171. The blades 172, however, may be formed and shaped in a variety of ways to execute the desired aerodynamics of the fan as described with respect to FIGS. 4A and 4B, above.

Although described in connection with a fan 70, 170 having blades 72 on the drum-facing side of body 71 or with blades 172 on both sides of the body 171, the fan may have essentially any configuration that allows sufficient air to be drawn from the drum chamber 23 (and optionally the exterior) and expelled through the discharge chute 52. The fan 70, 170 may be, for example, an axial fan, a centrifugal fan or a cross-flow fan. The fan 70, 170 may incorporate essentially any type of impeller or blade arrangement. For example, in one embodiment, the disc-like body may be eliminated and the blades may extend radially outward from a central axis.

The fan chamber 60 has an air outlet 76 adjacent the material outlet 50 of the chipping chamber 20. The receiving end 54 of the discharge chute 52 communicates with the air outlet 76. A baffle 78 extends from the partition wall 26 between the chipping chamber 20 and the fan chamber 60 into the discharge chute 52 between the material outlet 50 and the air outlet 76, dividing the receiving end 54 into a chip side 79 communicating with the chipping chamber 20 and an air side 80 communicating with the fan chamber 60.

Figure 6:
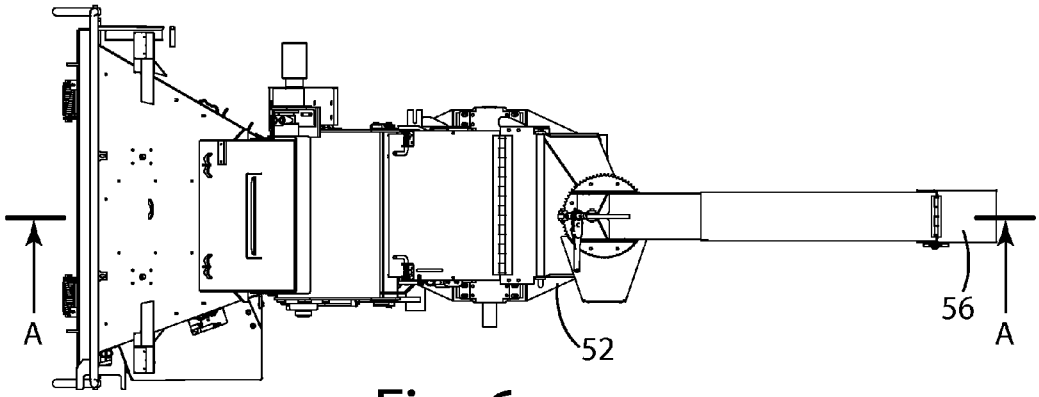
FIG. 6 is a top view of a portion of the chipping apparatus.
Figure 8:
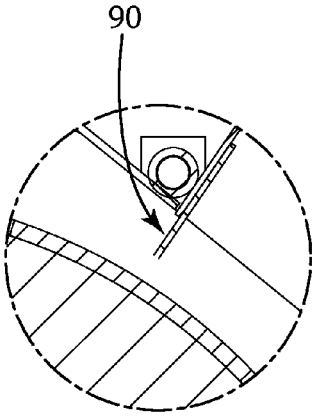
FIG. 8 is a detailed view of the air deflector.

Referring to FIGS. 6-8, a deflector 90 is located at the receiving end 54 of the chipping chamber 20 and extends into the chipping chamber 20 from the peripheral chamber wall 28. The deflector 90 provides a barrier to air flowing from the area at the mouth of the discharge chute into the chipping chamber 20 as created by the chipping drum 22 and the fan 70, 170 and further facilitates movement of the air flow toward the discharge chute 52. The size, shape and configuration of the deflector 90 may vary from one embodiment of the invention to another. In some embodiments, the deflector 90 may be eliminated altogether.

In operation, the fan 70, 170 rotates conjointly with the chipping drum 22 about the shaft 38 and draws air into the fan chamber 60 from the external inlets 66 and from the drum chamber inlet 67. The air flow created by the fan 70, 170 is a high velocity flow sufficient to overcome the negative air flow created by the spinning drum 22 and move air toward the discharge chute 52 and away from the material inlet 34. Wood chips that were reduced in the chipping chamber 20 are drawn to the discharge chute 52 at the receiving end 54 of the apparatus 10. As the wood chips are drawn by the air flow created by the fan 70 toward the material outlet 50 and discharge chute 52, the wood chips remain on the chip side 78 of the baffle and become entrained with the air flow create by the fan 70 once they pass the baffle 78.

Figure 9A:
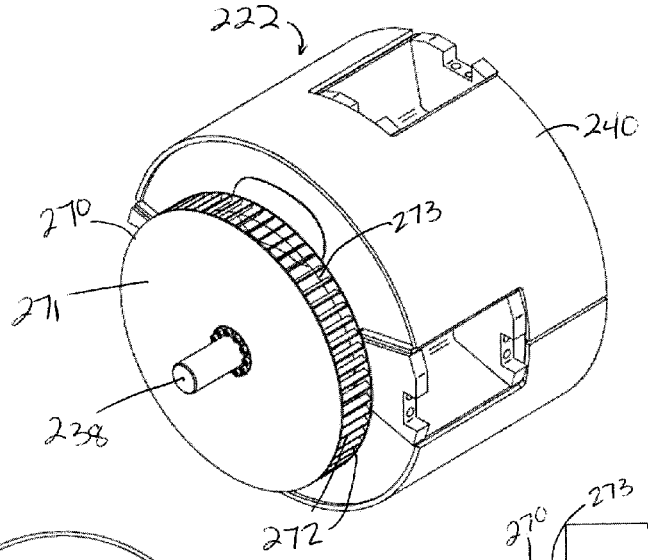
FIG. 9A is a perspective view of the drum and a squirrel fan.
Figure 9C:
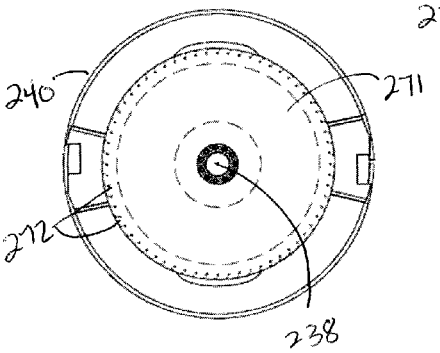
FIG. 9C is a side view of the drum and fan of FIG. 9A.
Figure 9B:
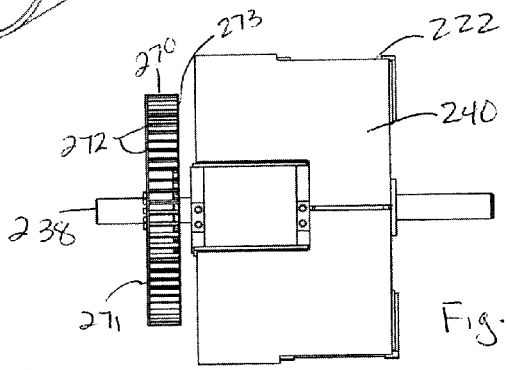
FIG. 9B is a top view of the drum and fan of FIG. 9A.

As noted above, the discharge fan may be essentially any type of fan capable of moving air through the system. For purposes of illustration, examples of alternative embodiments incorporating centrifugal fans are shown in FIG. 9A-C and 10A-C. Referring now to FIGS. 9A-9C, the fan 270 may be single sided centrifugal (or "squirrel cage" fan) disposed adjacent to the chipping drum 222. In this embodiment, the fan 270 includes a plurality of blades 272 extending axially from a disc-like body 271. The fan 270 may include a blade support ring 273 supporting the ends of the blades 272 opposite the disc-like body 271. As shown, the blades 272 of this embodiment are located on a single side of the disc-like body facing the partition wall 26 with the air inlet 67. The placement of blades 72, 272 on the side of the disc-like body 71, 271 facing the air inlet 67 facilitates movement of air from the drum chamber 23 into the fan chamber 60 through the air inlet 67. The size, shape, configuration, pitch and number of blades may vary. For example, with regard to shape, the blades 272 may be straight radial blades, forward-curved blades or rearward-curved blades, as desired. As with the embodiment shown in FIGS. 1-8, the fan 270 and the drum 222 are fixed to the shaft 238 for conjoint rotation.

Figure 10A:
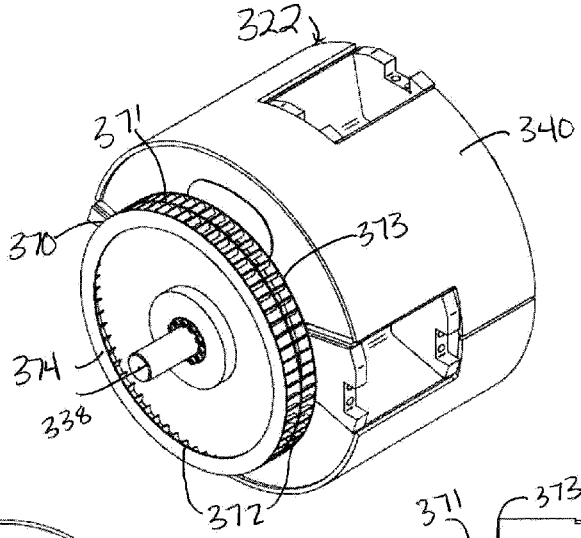
FIG. 10A is a perspective view of the drum and fan with two sets of blades.
Figure 10C:
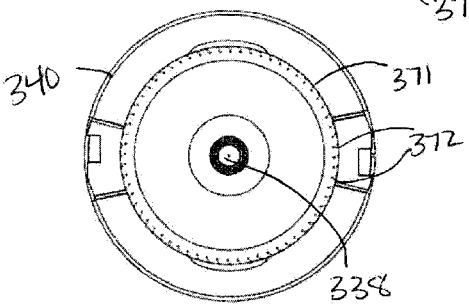
FIG. 10C is a side view of the drum and fan of FIG. 10A.
Figure 10B:
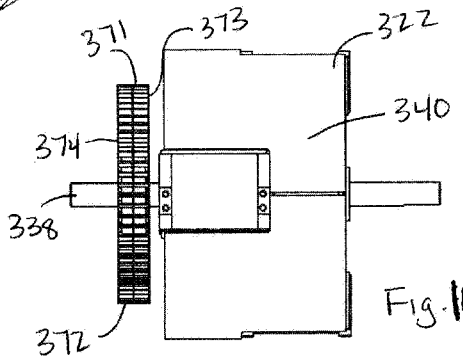
FIG. 10B is a top view of the drum and fan of FIG. 10A.

Referring now to FIGS. 10A-10C, the fan 370 may be a two-sided centrifugal fan disposed adjacent to the chipping drum 322. In this alternative embodiment, the fan 370 may include blades 372 on both sides of the disc-like body 371. This arrangement allows air to be drawn from the drum chamber through the air inlet 67, as well as from the exterior through exterior air inlet 66. As a result, the construction may serve to increase and optimize the amount of air flow created by the fan 370 toward the discharge 52. The fan 370 may, as shown, include an inner blade support ring 373 and outer blade support ring 374 that support the ends of the blades 373 opposite the disc-like body 371. As with the other fans 70, 170 and 270, the size, shape, configuration, pitch and number of blades on fan 370 may vary from application to application.

Directional terms, such as "vertical," "horizontal," "top," "bottom," "upper," "lower," "forwardly," "rearwardly," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The invention claimed is:

1. A wood chipper comprising:

a chipping drum fitted into a drum chamber;

a material infeed for feeding material into said chipping drum in said drum chamber;

a discharge chute for discharging chipped material from said drum chamber;

said material infeed, said drum chamber and said discharge chute defining a material flow path through the wood chipper; and an entrainment system having a fan fitted into a fan chamber, said entrainment system having an air inlet for drawing air into said fan chamber from said drum chamber, said entrainment system having a discharge outlet for expelling air from said fan chamber toward said discharge chute, said fan and said fan chamber disposed outside of said material flow path, whereby said fan is not subjected to chipped material.

2. The wood chipper of claim 1 wherein said entrainment system has an exterior inlet for drawing air into said fan chamber from the exterior.

3. The wood chipper of claim 1 wherein said chipping drum and said fan are mounted on a common shaft, whereby said chipping drum and said fan are rotatably driven together.

4. The wood chipper of claim 1 wherein said drum chamber and said fan chamber are separated by a partition wall, said air inlet from said drum chamber defined by an aperture in said partition wall.

5. The wood chipper of claim 1 wherein said fan includes a disc-like body mounted on said shaft within said fan chamber, said body including an inner surface facing said drum chamber, said fan including a plurality of blades extending from said inner surface of said body.

6. The wood chipper of claim 5 wherein said fan includes a disc-like body mounted on said shaft within said fan chamber, said body including an inner surface facing said drum chamber and an outer surface facing away from said drum chamber, said fan including a plurality of blades extending from said inner surface and from said outer surface of said body.

7. The wood chipper of claim 1 wherein a deflector is attached to a peripheral wall adjacent said discharge chute.

8. The wood chipper of claim 1 wherein said fan is a centrifugal fan.

9. A wood reduction apparatus having an air entrainment system comprising:

a fan chamber and a drum chamber internal to a housing for the apparatus, said fan chamber separated from said drum chamber by a partition wall;

said drum chamber defining a material outlet for ejecting chipped material from said drum chamber;

a discharge chute for discharging chipped material, said discharge chute being in fluid communication with said material outlet to receive chipped material from said drum chamber, said drum chamber, said material outlet and said discharge chute defining a material flow path for chipped materials to be discharged from the wood reduction apparatus;

an aperture in said partition wall allowing fluid communication between said drum chamber and said fan chamber;

an external air inlet in said fan chamber opposite said aperture;

a fan fixed in said fan chamber, said fan drawing air from said drum chamber and from said external air inlet and moving said drawn air toward a discharge end of the discharge chute, said fan and said fan chamber disposed outside of said material flow path, whereby said fan is not subjected to chipped material.

10. The apparatus of claim 9 wherein said drum chamber contains a chipping drum fixed on a shaft with said fan allowing conjoint rotation of said fan and said chipping drum.

11. The apparatus of claim 9 wherein said fan comprises a disc with at least one blade fixed thereon.

12. The apparatus of claim 11 wherein a plurality of blades are fixed on a side of said disc adjacent to said chipping chamber.

13. The apparatus of claim 12 wherein an opposite side of said disc is affixed with a plurality of blades.

14. The apparatus of claim 11 wherein a plurality of blades are fixed on a side of said disc adjacent to said external inlet.

15. The apparatus of claim 9 wherein said fan is a centrifugal fan.

16. A method for reducing wood debris in a wood chipper, the method comprising the steps of:

providing a wood chipper having a material inlet, a drum chamber, a fan chamber and a discharge chute, the drum chamber and the discharge chute defining a material flow path for chipped material to be discharged from the wood chipper;

rotatably disposing a chipping drum in said drum chamber;

rotatably disposing a fan in said fan chamber, the fan and the fan chamber being disposed outside of the material flow path, whereby said fan is not subjected to chipped material;

providing an air passage from said drum chamber to said chipping chamber; and rotating the chipping drum and the fan such that the chipping drum chips material in the drum chamber and ejects the chipped material from the drum chamber into the discharge chute and such that air is drawn into said fan chamber from said drum chamber and expelled through said discharge chute.

17. The method of claim 16 further comprising the steps of;

providing an air passage between said fan chamber and an exterior of the wood chipper; and operating said fan to draw air into said fan chamber from said exterior.

18. The method of claim 16 whereby a volume of wood chips reduced in the chipper is entrained in said air in said discharge chute.

19. The method of claim 18 further comprising the step of providing a deflector in said discharge chute to direct said air away from said drum chamber.

20. An apparatus for reducing wood debris to chips comprising:

a housing with an internal chipping chamber having a peripheral wall;

a material inlet provided in said peripheral wall of said chipping chamber;

a base of said chipping chamber having a drum chamber and a fan chamber; said fan chamber in fluid communication with both said chipping chamber and an external air inlet opposite said drum chamber air inlet;

a chipping drum within said drum chamber supported by a shaft in said base;

a fan within said fan chamber adjacent said drum chamber and separated from said drum chamber by a partition wall, said fan supported by said shaft, said fan and said chipping drum conjointly rotatable about said shaft; and a discharge chute at said material outlet end of said chipping chamber;

wherein said drum chamber and said discharge chute define a material flow path for discharging chipped material from the apparatus, said fan and said fan chamber being disposed outside of the material flow path, whereby said fan is not subjected to chipped material.

21. The apparatus of claim 20 wherein an air flow is created in a direction from said material inlet and said external air inlet toward a material outlet in said chamber wall for discharging a volume of chipped material from said chipping chamber.

22. The apparatus of claim 20 further comprising a deflector in said discharge chute to direct air away from said chipping chamber.

* * * * *